US007380641B2

(12) United States Patent
Dos Santos

(10) Patent No.: US 7,380,641 B2
(45) Date of Patent: Jun. 3, 2008

(54) ELEVATOR WITH A CONTROL USING OPTICAL FIBERS

(75) Inventor: Murilo Lopes Dos Santos, São Paulo (BR)

(73) Assignee: Inventio AG, Hergiswil (CH)

( * ) Notice: Subject to any disclaimer, the term of this patent is extended or adjusted under 35 U.S.C. 154(b) by 631 days.

(21) Appl. No.: 11/005,135

(22) Filed: Dec. 6, 2004

(65) Prior Publication Data

US 2005/0121264 A1 Jun. 9, 2005

(30) Foreign Application Priority Data

Dec. 8, 2003 (EP) ..... 03405876

(51) Int. Cl.
*B66B 1/34* (2006.01)

(52) U.S. Cl. ..... 187/395; 187/391

(58) Field of Classification Search ..... 187/316, 187/317, 313, 391–396; 18/316, 317, 313, 18/391–396

See application file for complete search history.

(56) References Cited

U.S. PATENT DOCUMENTS 4,577,177 A * 3/1986 Marubashi ..... 187/396
4,623,869 A 11/1986 Marubashi
4,716,992 A * 1/1988 Kunii ..... 187/395
5,345,531 A * 9/1994 Keplinger et al. ..... 385/102
5,616,895 A * 4/1997 Spiess ..... 187/280
5,950,767 A * 9/1999 Kamani ..... 187/335
6,161,654 A * 12/2000 Sirigu et al. ..... 187/391
6,496,628 B1 * 12/2002 Opel et al. ..... 385/110
6,629,583 B2 * 10/2003 Valk et al. ..... 187/391
6,945,363 B2 * 9/2005 Angst et al. ..... 187/317

FOREIGN PATENT DOCUMENTS

FR 2 775 272 A1 8/1999
JP 02062387 A * 3/1990 ..... 187/395
JP 08-169655 7/1996
JP 2002062387 2/2002
JP 2002348067 A 12/2002

* cited by examiner

*Primary Examiner*—Jonathan Salata
(74) *Attorney, Agent, or Firm*—Klaus P. Stoffel; Wolff & Samson PC

(57) ABSTRACT

An elevator with an all optical control apparatus having a control unit with a light source, a photodetector, an optical feeding fiber, and an optical feedback fiber. The light source is coupled to the optical feeding fiber and the optical feedback fiber is coupled to the photodetector. The all optical control apparatus further includes a member that can be manually actuated. The member has a fiber input and a fiber output. The fiber input is optically coupled to the optical feeding fiber and the fiber output is optically coupled to the optical feedback fiber. The member, when actuated, influences a light path between the fiber input and the fiber output in a manner that is detectable at the photodetector.

12 Claims, 3 Drawing Sheets

ELEVATOR WITH A CONTROL USING OPTICAL FIBERS

BACKGROUND OF THE INVENTION

The present invention concerns an elevator having an optical system for initiating or triggering a function, such as a call for an elevator cabin.

In some elevator installations optical fibers are used to transmit information from a machine room control unit to an elevator display device, but these optical fibers have not fully replaced the electrical wiring and power lines required for power supply purposes and for signal transmission. The electrical supply is for example required to drive electronic information processing circuits and devices at the elevator landing area sites. In addition, certain elements at the elevator landing area sites and/or inside the elevator cabin require an electrical power supply. In consequence, the installation of these types of elevator installations is tedious, costly and error prone.

An example of an elevator with fiber-based optical information and power transmission is described in U.S. Pat. No. 4,623,869. In this patent, light pulses are transmitted via an optical fiber to a boarding area site where they are converted into electrical energy by means of a photoelectric transducer. Information is transmitted via the same fiber in the form of different pulses. These pulses are forwarded to a beam deflection unit which projects the optical information onto a viewing screen. The beam deflection unit is electro-mechanically operated, that is, it requires electrically powered devices. According to this US patent, electrical energy is converted into optical energy before it is transmitted through the fiber. At the receiving end, the optical energy is converted back into electrical energy, or electrical energy is required to mechanically deflect the optical beam onto the viewing screen. Such a hybrid approach is complex and expensive.

There are other examples of elevator installations that require a conversion from electrical into optical energy and at the receiving end a conversion back into electrical energy. One example is given in the Japanese patent application JP2002348067A.

Yet another approach is addressed in the Japanese patent application JP2002062387A. This Japanese patent application discloses an elevator where a button is illuminated by a lamp that is spaced apart from the button in order to prevent the lamp from being destroyed by vibrations inside the button. The lamp is connected to the button by means of an optical fiber.

All systems and approaches known so far are hybrid systems, where conversions from an electrical to an optical regime and from the optical to the electrical regime are required.

Conventional systems use too much space and are interference prone. Depending on the implementation, special communication protocols are required for communication between the control unit in the elevator's machine room and the panels on the different landing floors. Traveling direction devices and other indicators have the same problem.

SUMMARY OF THE INVENTION

Accordingly, it is an object of the present invention to provide an elevator installation which makes it possible to eliminate the need for some or all of the electrical wiring between each elevator boarding area and the elevator control system.

Pursuant to this object, and others which will become apparent hereafter, one aspect of the present invention resides in an elevator with an all optical control apparatus. The control apparatus comprises a control unit with a light source, a photodetector, an optical feeding fiber, and an optical feedback fiber. The light source is coupled to the optical feeding fiber and the optical feedback fiber is coupled to the photodetector. The apparatus further comprises a member that can be manually actuated. The member is coupled to the optical feeding fiber and the feedback fiber so that, when the member is actuated a light path is influenced in a manner that is detectable at the photodetector.

Other features and advantages of the present invention will become apparent from the following description of the invention which refers to the accompanying drawings.

BRIEF DESCRIPTION OF THE DRAWINGS

For a more complete description of the present invention and for further objects and advantages thereof, reference is made to the following description, taken in conjunction with the accompanying drawings, in which.

DETAILED DESCRIPTION OF THE INVENTION

Figure 1A:
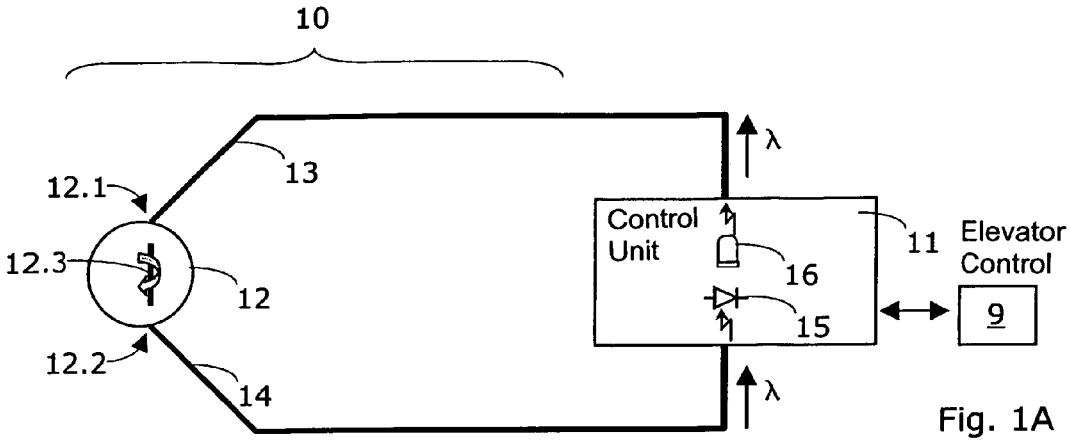
FIG. 1A is a schematic representation of an all optical control apparatus, according to a first embodiment of the present invention.
Figure 1B:
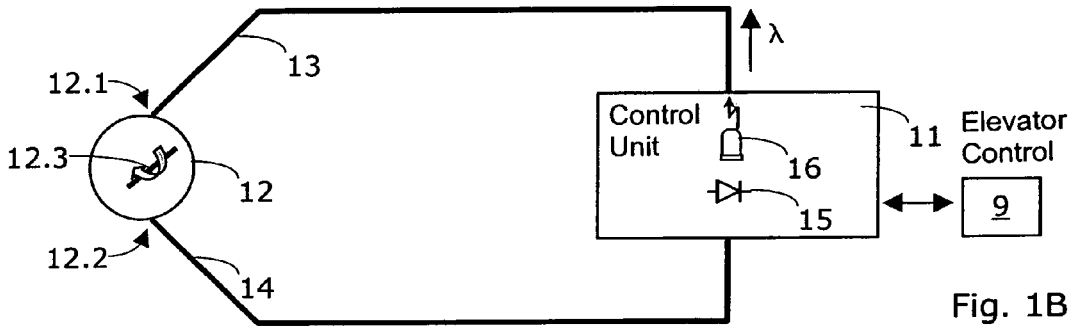
FIG. 1B is a schematic representation of the all optical control apparatus of FIG. 1A after the member has been actuated.

According to the present invention, an all optical control apparatus 10 is provided. A first embodiment is illustrated in FIGS. 1A and 1B. "All optical" in the context of the present patent application means that no electrical wiring and no conversion from the optical to the electrical regime is required at a remote site.

The all optical control apparatus 10 comprises a control unit 11 with a light source 16 and a photodetector 15. Well suited as the light source 16 is a laser or a light emitting diode. Preferred embodiment employ one or more light emitting diodes, since these diodes are not as expensive as lasers and, even more importantly, are more robust. The apparatus 10 further comprises an optical feeding fiber 13 and an optical feedback fiber 14. The light source 16 is optically coupled to the optical feeding fiber 13 so that light (depicted by a flash symbol, for sake of simplicity) emitted by the light source 16 is coupled into the fiber 13 and guided through the fiber 13. A member 12 is provided that can be manually actuated. There are various ways to actuate the member, as will be discussed below in connection with different embodiments. The word "actuate" does not necessarily mean that a mechanical movement is caused. The word "actuate" in the present context is also meant to cover non-mechanical activities. The member 12 comprises a fiber input 12.1 and a fiber output 12.2. The fibers 13, 14 may be attached, linked or coupled to the input 12.1 and the output 12.2 to provide an optical coupling that allows light to be coupled from the feed fiber 13 into the member 12 and from the member 12 into the feedback fiber 14. The feedback fiber 14 is optically coupled to the photodetector 15, as schematically illustrated in FIG. 1A and FIG. 1B. The member 12, when actuated, influences a light path 12.3 between the fiber input 12.1 and the fiber output 12.2 in a manner that is detectable at the photodetector 15.

In FIG. 1A a state is shown, where light is emitted by a diode 16, guided through the fiber 13 to the member 12, and from the member 12 through the fiber 14 back to the photodetector 15. In this state, a closed optical loop is provided and the photodetector generates an electrical signal (photo current) that can be processed by some electrical circuitry not shown in the Figures. If now the member 12 is actuated, as schematically illustrated in FIG. 1B, the light path 12.3 is influenced, in which case the electrical signal provided by the photodetector 15 is reduced, or the light path 12.3 is interrupted in which case the electrical signal may go down to zero. In FIG. 1B, the later case is illustrated and no light reaches the photodetector 15. The electrical circuitry is now able to detect this change in light intensity and an action or reaction can be caused. For this purpose, the apparatus 10 may be coupled to an electrical elevator control 9, as shown in FIGS. 1A and 1B.

Figure 2A:
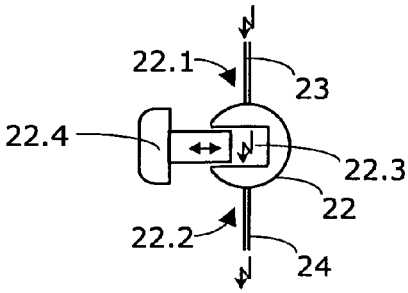
FIG. 2A is a schematic representation of a first member, according the present invention.
Figure 2B:
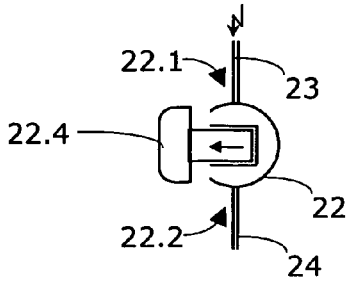
FIG. 2B is a schematic representation of the member of FIG. 2A after the member has been actuated.

A first embodiment of a member 22 is schematically illustrated in FIGS. 2A and 2B. The member 22 can be manually actuated by pressing a button 22.4, as indicated in the Figures by means of arrows. The member 22 comprises a fiber input 22.1 and a fiber output 22.2. The fibers 23, 24 may be attached, linked or coupled to the input 22.1 and the output 22.2 to provide an optical coupling that allows light to be coupled from the fiber 23 into the member 22 and from the member 22 into the fiber 24. In FIG. 2A a state is shown, where a light path 22.3 exists between the input 22.1 and the output 22.2. If the button 22.4 is pushed, a portion of the button moves into the light path 22.3 and influences or even interrupts the light path, as shown in FIG. 2B. In this case, light with reduced intensity or no light is provided at the output side 22.2. This is detectable at the control unit's photodetector 15.

The button 22.4 may be guided or mounted so that it springs back after it was pushed. In this case, the actuation leads to a temporary influence or interruption of the light path 22.3.

Figure 3A:
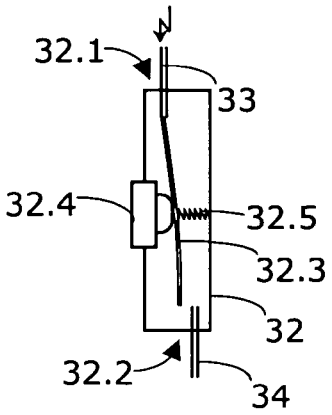
FIG. 3A is a schematic representation of a second member, according the present invention.
Figure 3B:
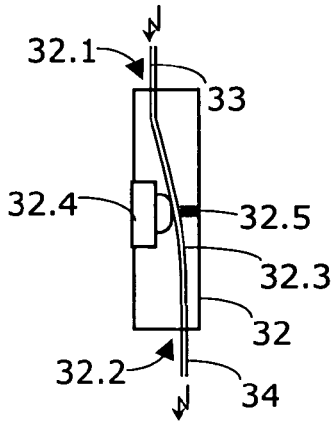
FIG. 3B is a schematic representation of the member of FIG. 3A after the member has been actuated.

A second embodiment of a member 32 is schematically illustrated in FIGS. 3A and 3B. The member 32 can be manually actuated by pressing a button 32.4, as indicated in the Figures by means of arrows. The member 32 comprises a fiber input 32.1 and a fiber output 32.2. The fibers 33, 34 may be attached, linked or coupled to the input 32.1 and the output 32.2 to provide an optical coupling that allows light to be coupled from the fiber 33 into the member 32 and from the member 32 into the fiber 34. A flexible fiber element 32.3 is provided inside the member 32. A spring 32.5 is arranged to push the flexible fiber 32.3 into a position where no light is coupled from the flexible fiber 32.3 into the fiber 34. If the button 32.4 is pushed down, as illustrated in FIG. 3B, the fiber 32.3 is moved into a position where light is coupled from the fiber 32.3 into the fiber 34. In this state, the optical loop is closed and the control unit's photodetector 15 receives light through the fiber 34. The light is only coupled into the fiber 34 as long as the button 32.4 is pushed. If the button 32.4 is released, the spring 32.5 moves the flexible fiber 32.3 and the button 32.4 back into the original position shown in FIG. 3A.

Figure 4A:
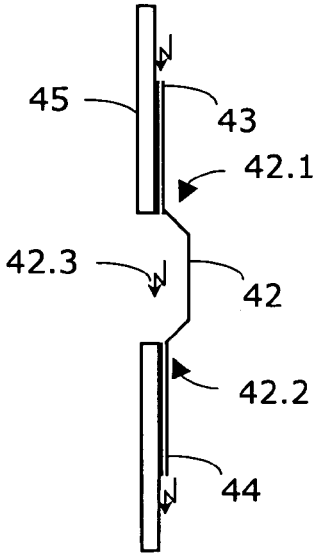
FIG. 4A is a schematic representation of a third member, according the present invention.
Figure 4B:
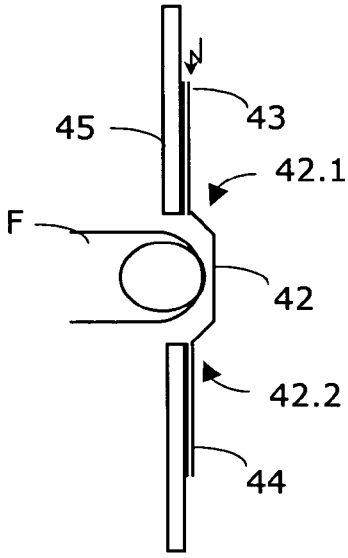
FIG. 4B is a schematic representation of the member of FIG. 4A after the member has been actuated.
Figure 4C:
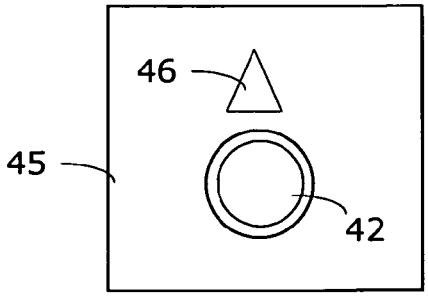
FIG. 4C is a schematic front view of the member of FIG. 4A.

A third embodiment of a member 42 is schematically illustrated in FIGS. 4A, 4B and 4C. The member 42 can be manually actuated by moving a finger F, as indicated in FIG. 4B, into a recess of the member 42. The member 42 comprises a fiber input 42.1 and a fiber output 42.2. The fibers 43, 44 may be attached, linked or coupled to the input 42.1 and the output 42.2 to provide an optical coupling that allows light to be coupled from the fiber 43 into the member 42 and from the member 42 into the fiber 44. A light path 42.3 is provided between the input 42.1 and the output 42.2, as illustrated in FIG. 4A. If a finger F is moved into the recess of the member 42, the light path is disturbed or interrupted and no light is received and guided by the fiber 44 towards the control unit. In the normal state, the optical loop is closed and the control unit's photodetector 15 receives light through the fiber 44. The member 42 may be integrated into a panel 45. The panel 45 may further comprise an all optical indicator 46, as will be discussed below in connection with subsequent Figures. The member 42 functions like a touch sensitive button.

The all optical control apparatus allows all electrical functions to be realized in an area, e.g. in a control room or machine room of the elevator, that is remote from the location where the member is reachable by a user of the elevator. From this area, only two fibers, the feeding fiber and the feedback fiber, are required to enable the user to do any of the following:

- to register a call for an elevator cabin, or
- to register a destination floor, or
- to register an emergency call.

As addressed in connection with the different embodiments, the members can be realized so that,

- when actuated they interrupt a light path so that no light or light with reduced intensity is received at the photodetector, or
- when actuated they connect/establish/improve a light path so that light is received at the photodetector.

Instead of using a button or finger, one can also use a key or another element that is able to influence the light path.

The all optical control apparatus, according to the present invention, serves as a fiber-based remote control.

It is an advantage of the present invention, that the all optical control apparatus can be expanded to also include an all optical indicator. As illustrated in FIG. 4C, almost all elevator control panels require some kind of optical indicator 46 in order to give some feedback after a button was pressed, or to announce that an elevator cabin is about to arrive, for example. Indicators may also be used to indicate a certain state or position of the cabin, to inform the passengers that an overload situation has occurred, that a cabin is to be evacuated, and so forth. According to the present invention, no electrical cabling is required to realize an optical indicator. Two embodiments will be discussed in connection with FIGS. 5 and 6.

Figure 5:
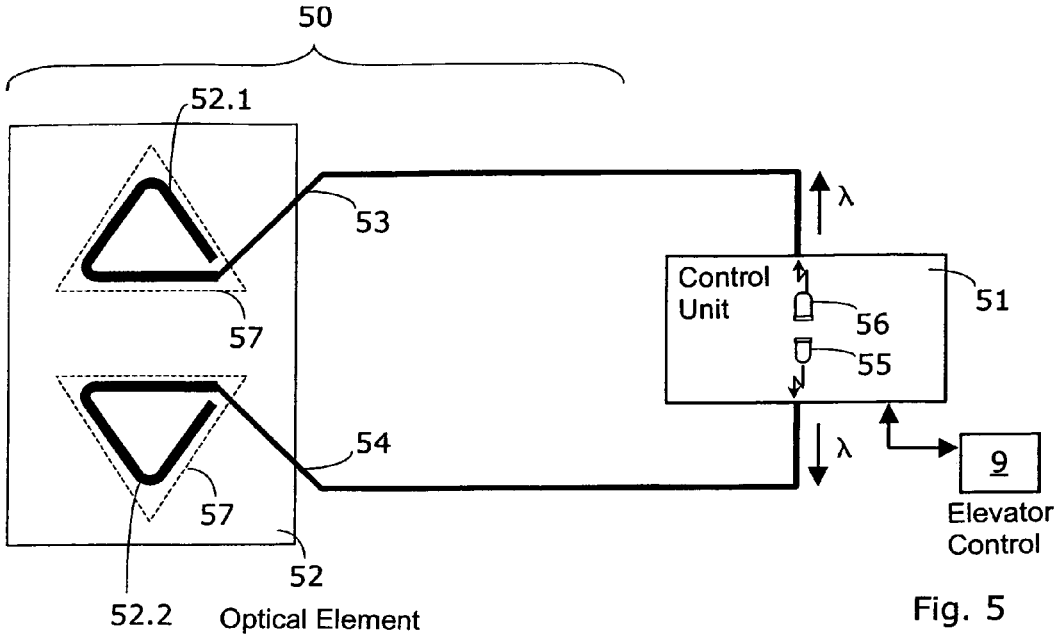
FIG. 5 is a schematic representation of an all optical control indicator, according to a second embodiment of the present invention.

An all optical indicator 50, as schematically shown in FIG. 5, comprises light sources 55, 56 at a control unit 51, optical supply fibers 53, 54 connected to the light sources 55, 56, and an optical element 52. In the present example, the optical element 52 comprises two fiber segments 52.1 and 52.2, that each have the form of a triangle. The fiber segment 52.1 forms a triangle that points upwards and the fiber segment 52.2 forms a triangle that points downwards. If a user has called an elevator cabin, the indicator 50 may be used to indicate the current traveling direction of the cabin by illuminating the respective triangle. If the cabin moves upwards, the light source 56 is activated and light is optically coupled into the supply fiber 53. This fiber 53 guides the light from the light source 55 to the fiber segment 52.1. The fiber segment 52.1 allows light to escape the fiber as if the triangle would emit light. Due to this, an upwards pointing triangle becomes visible. If the cabin moves downwards, the light source 55 is activated and the triangle 52.2 starts to "emit" light.

The optical element 52 may be part of a panel or plate that is situated at a landing floor or inside the elevator cabin.

To hide the fiber segments 52.1, 52.2, diffusing elements 57 may be situated on top, as illustrated in FIG. 5 by means of dashed lines. The diffusing element not only provides for a diffusion of the light that escapes the fiber segments underneath, but it also can be touched.

Figure 6:
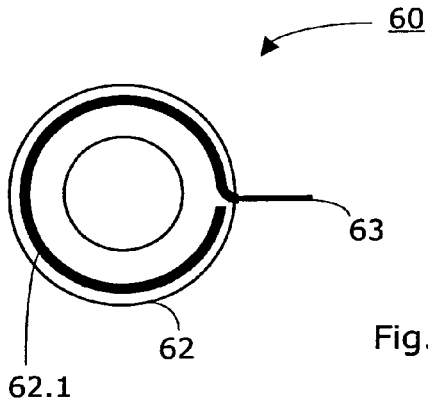
FIG. 6 is a schematic representation of an all optical control indicator, according to a third embodiment of the present invention.

Another all optical indicator 60, as schematically shown in FIG. 6, comprises a light source, an optical supply fiber 63 connected to the light source, and an optical element 62. In the present example, the optical element comprises one fiber segment 62.1, that has the form of a circle. If a user has called an elevator cabin, the indicator 60 may be used to indicate that a call was placed by activating the light source. The light will be guide through the fiber 63 to the fiber segment 62.1 where at least some of the light escapes the fiber; Due to this, a circle becomes visible. The fiber segment 62.1 may be situated behind a transparent shield.

The all optical indicators may be employed:

to indicate that a call for an elevator cabin is registered, or to indicate that a destination floor is registered, or to indicate the traveling direction of the elevator cabin, or to indicate that an emergency call is registered, just to give some examples.

The all optical control indicators, according to the present invention, serve as a remotely, optically driven display indicating a state (e.g., traveling direction, call registered, confirmation signal etc.) of the elevator.

It is advantageous to use bare plastic fiber segments, preferably PMMA fiber segments. Well suited is a fiber called Poly Bright™, or any other kind of side light fiber that allows light to escape. For this purpose, the fiber may be structured. If one applies cuts or if the fiber has a roughened surface, some of the light is deflected out of the fiber core. Those parts of the fiber segments that are not supposed to emit light can be covered by a resin or can be put in a thin hose or tube-shaped element.

One may also use multicolor all optical indicators.

The fiber segments may be used without any protective shield or without any diffusing element if the fiber segments themselves are protected against mechanical damage. To protect a fiber segment, a protective coating or cladding may be applied. Such a coating also may protect the fiber segments against fire. Fiber segments with coating or cladding can be embedded directly in walls, cement or concrete.

The optical fibers that are being situated between the remote area where the control unit is placed and the location where the user has access to the member or where the indicator is visible, may be protected by means of a coating or cladding as well. The optical fibers may be clad in a PVC covering, for example. This is recommended if the fibers are applied without any protective tubing.

Fiber connectors may be used for easier installation and maintenance. Such connectors allow two optical fibers to be connected and, if needed, to be disconnected again.

It is also possible to use one light source for several functions. One light source may for example be used to feed light via one common fiber to a member for calling a cabin and to an indicator associated with this member. Such an embodiment would allow a push button to be realized that in its normal state is dark. If somebody pushed the button to call a cabin, the light path to the photodetector is interrupted temporarily and the light is guided into a fiber segment, like the one in FIG. 6, instead. That is, as long as the button is pushed, the button emits light. This gives the user a confirmation that the button was pushed hard enough. If the button is released, the light path is re-established and the button stops emitting light.

Preferably, the control unit is located in or near to the elevator's machine room. The corresponding supplier and logic is placed at the control unit. The control unit may be connected to the electrical elevator control 9, as indicated in FIGS. 1A, 1B, and 5.

It is an advantage of the present invention that the light source is located at or close to the machine room where an electrical power supply is easily available. It is also easier to replace defective elements, since all sensitive elements, such as the light sources are placed at one and the same location. One does not have to visit floor by floor to check and replace broken lamps, like in conventional systems.

The present invention enables solutions that are appealing from an aesthetic point of view. The respective panels at the landing floors and inside the cabin can be slimmer, for example.

It is another advantage that the control unit can be placed in a rack or room that is fire proof. Since the fibers are able to withstand heat and fire better than most electrical cabling, this allows to realize elevators that provide certain basic function even in case of fire.

In the drawings and specification there has been set forth preferred embodiments of the invention and, although specific terms are used, the description thus given uses terminology in a generic and descriptive sense only and not for purposes of limitation.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An elevator with an all optical control apparatus comprising:

a control unit with a light source and a photodetector;

an optical feeding fiber optically coupled to the light source;

an optical feedback fiber optically coupled to the photodetector; and a member that can be manually actuated, said member comprising a fiber input and a fiber output, said fiber input being optically coupled to said optical feeding fiber and said fiber output being optically coupled to said optical feedback fiber, said member being actuable so as to influence a light path between said fiber input and said fiber output in a manner that is detectable at the photodetector, wherein said member comprises a push button that is actuable to interrupt the light path so that no light is receivable at the photodetector and triggers a call for an elevator cabin.

2. The elevator according to claim 1, wherein said member comprises a push button or key that is actuable to connect the light path so that light is receivable at the photodetector.

3. The elevator according to claim 1, wherein the photodetector is operative to produce an electrical output signal for registering a call for an elevator cabin, registering a destination floor, or registering an emergency call.

4. The elevator according to claim 1, and further comprising an all optical indicator having a light source at the control unit, an optical supply fiber connectable to said light source, and an optical element, said optical supply fiber being arranged to guide light from said light source to said optical element so that light becomes visible when coupled at said control unit into said optical supply fiber.

5. The elevator according to claim 4, wherein the all optical indicator is operative to indicate that a call for an elevator cabin is registered, to indicate that a destination floor is registered, to indicate the traveling direction of an elevator cabin, or to indicate that an emergency call is registered.

6. The elevator according to claim 1, wherein said member is located at a landing floor.

7. The elevator according to claim 1, wherein said member is located inside an elevator cabin.

8. The elevator according to claim 4, wherein said all optical indicator is located at a landing floor.

9. The elevator according to claim 4, wherein said all optical indicator is located inside an elevator cabin.

10. The elevator according to claim 4, wherein said optical element comprises a plastic fiber.

11. The elevator according to claim 10, wherein the optical element comprises a PMMA fiber.

12. The elevator according to claim 1, wherein said control unit is connectable to an electrical elevator control.

* * * * *